US010476135B2

(12) United States Patent
Yen

(10) Patent No.: US 10,476,135 B2
(45) Date of Patent: Nov. 12, 2019

(54) PORTABLE ELECTRONIC DEVICE WITH EMBEDDED ANTENNA

(71) Applicant: Netgear, Inc., San Jose, CA (US)

(72) Inventor: Jorg (Chih-Chuan) Yen, San Diego, CA (US)

(73) Assignee: Arlo Technologies, Inc., Carlsbad, CA (US)

( * ) Notice: Subject to any disclaimer, the term of this patent is extended or adjusted under 35 U.S.C. 154(b) by 168 days.

(21) Appl. No.: 15/631,461

(22) Filed: Jun. 23, 2017

(65) Prior Publication Data

US 2018/0375192 A1 Dec. 27, 2018

(51) Int. Cl.

| | |
|---|---|
| ***H01Q 1/24*** | (2006.01) |
| ***H01Q 9/04*** | (2006.01) |
| ***H01Q 9/28*** | (2006.01) |
| ***H01Q 13/10*** | (2006.01) |

(52) U.S. Cl.

CPC ..... *H01Q 1/243* (2013.01); *H01Q 1/24* (2013.01); *H01Q 9/04* (2013.01); *H01Q 9/0414* (2013.01); *H01Q 9/28* (2013.01); *H01Q 13/10* (2013.01)

(58) Field of Classification Search

CPC ..... H01Q 1/243; H01Q 9/0414; H01Q 1/24; H01Q 9/04; H01Q 1/50; H01Q 9/28; H01Q 13/10

USPC ..... 343/873, 700 MS

See application file for complete search history.

(56) References Cited

U.S. PATENT DOCUMENTS

| | | | | |
|---|---|---|---|---|
| 7,999,736 | B2 | 8/2011 | Albrecht | |
| 9,397,727 | B1 | 7/2016 | Mattsson et al. | |
| 2005/0156788 | A1* | 7/2005 | Lin | H01Q 1/38 343/700 MS |
| 2012/0206302 | A1 | 8/2012 | Ramachandran et al. | |
| 2013/0194137 | A1 | 8/2013 | Jeong | |
| 2014/0015722 | A1* | 1/2014 | Lim | H01Q 1/50 343/749 |
| 2014/0079269 | A1* | 3/2014 | Choi | H04R 1/04 381/365 |

* cited by examiner

*Primary Examiner* — Hai V Tran
(74) *Attorney, Agent, or Firm* — Boyle Fredrickson, S.C.

(57) ABSTRACT

A portable electronic device wirelessly communicates using an embedded antenna which includes a ground plane for electronics of the device and one or more additional planes extending at any angle diverging from the ground plane. The angles between the ground plane and the one or more additional planes can be configured so that the overall antenna is physically contained within a housing of the device. A slot or notch can be configured between the planes so that the antenna can effectively operate as a slot antenna. The antenna can be sized in the device to enable near field communications, such as Bluetooth, or greater distance communications, such as Wi-Fi and/or cellular. The device could be a camera configured to communicate in a security system.

20 Claims, 6 Drawing Sheets

PORTABLE ELECTRONIC DEVICE WITH EMBEDDED ANTENNA

BACKGROUND OF THE INVENTION

1. Field of the Invention

The present invention relates to portable electronic devices which can wirelessly communicate, and more particularly, to a portable electronic device configured to communicate using an embedded antenna formed from a ground plane for electronics of the device and one or more additional planes extending at angles to the ground plane.

2. Discussion of the Related Art

Portable electronic devices, such as wireless cameras used in security systems, are being integrated with increasing amounts of hardware for achieving even greater capabilities. One example of such increasing hardware relates to wireless communications for such devices. To achieve communications at greater distances using an increasing number of protocols, such devices now include more complex circuits and antennas, such as MIMO (multiple-input and multiple-output) structures using multiple transmit and receive antennas for communicating via multipath propagations.

However, it is desirable to substantially maintain the size and shape, or form factor, for such devices to support compatibility and/or ease of handling. In some instances, it is in fact desirable to reduce the size of such devices altogether. A need therefore exists to provide a portable electronic device which can wirelessly communicate with greater capability while maintaining substantially the same form factor or even reducing the device's size.

SUMMARY OF THE INVENTION

A portable electronic device can be configured to wirelessly communicate using an embedded antenna which includes a ground plane for electronics of the device and one or more additional planes extending at any angle diverging from the ground plane. The angles between the ground plane and the one or more additional planes can be configured so that the overall antenna is physically contained within a given form fit, such as one suitable for containment in a housing of the device. A slot or notch can be configured between the planes so that the antenna can effectively operate as a slot antenna. The antenna can be sized in the device to enable near field communications, such as Bluetooth, or greater distance communications, such as Wi-Fi and/or cellular. In one aspect, the device could be a wireless camera configured to communicate in a security system.

Accordingly, in one aspect, the invention can provide one or more compact embedded slot antennas in which an existing three-dimensional mechanical structure of a device can be utilized to minimize space requirements. Components used for the one or more antennas could include a Printed Circuit Board (PCB) stack-up of an electronic device, additional/extended ground plane(s) connected to the PCB, and/or a matching network for the antenna, thereby forming an embedded antenna system. The additional/extended ground plane(s) or extension(s) can be connected to the main/system ground of the PCB to form one or more slots or notches in between. The dimension and placement of the PCB, ground extension(s) and slot(s) or notch(es) can allow the antenna(s) to effectively radiate electromagnetically to communicate. Moreover, for small electronic devices such as a security camera, matching networks can allow each antenna to radiate at specific frequencies or ranges.

In one implementation, a camera can be implemented with the aforementioned compact embedded slot antenna. The camera can contain multiple PCB's stacked over one another to achieve various system functions. If it is battery powered, the camera can also include a rechargeable battery. An extended ground plane can be connected to ground plane of a main PCB of the multiple PCB's. The extended ground plane, together with the ground plane of the main PCB, can form a three-dimensional radiating slot structure. A Radio Frequency (RF) communications circuit can then apply a frequency dependent feed point to the structure to efficiently serve as an antenna from the original PCB stack-up of the device. This can advantageously minimize space requirements for wirelessly communicating via an antenna system. In addition, multiple antennas can be created within the same PCB stack-up without substantially growing the size of the device. In one aspect, the antenna can operate in the frequency range of 700 MHz to 3 GHz, so that the antenna can support many communications protocols, including, for example, near field communications, such as Bluetooth, cellular communications, such as LTE (Long Term Evolution), Code-Division Multiple Access (CDMA), and the like, as well as Wireless Local Area Network (WLAN) or Wi-Fi communications, such as IEEE 802.11.

Specifically then, one aspect of the present invention can provide a communications system including: multiple electrical components; a first conductive plane providing an electrical ground for the multiple electrical components; a second conductive plane electrically connected to the first conductive plane to form an antenna including the first and second conductive planes, in which the first and second conductive planes extend at an angle to one another; and a Radio Frequency (RF) communications circuit configured to communicate using the antenna.

Another aspect of the present invention can provide a wireless camera including: a power supply; an image sensor powered by the power supply; a first conductive plane providing an electrical ground for the image sensor; a second conductive plane electrically connected to the first conductive plane to form an antenna including the first and second conductive planes, in which the first and second conductive planes extend at an angle to one another; and a Radio Frequency (RF) communications circuit configured to communicate using the antenna.

Yet another aspect of the present invention can provide a method for manufacturing a communications system. The method includes mounting multiple electrical components to a PCB; providing a first conductive plane as an electrical ground for the multiple electrical components; electrically connecting a second conductive plane to the first conductive plane to form an antenna including the first and second conductive planes, in which the first and second conductive planes extend at an angle to one another; and configuring an RF communications circuit to communicate using the antenna.

These and other features and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
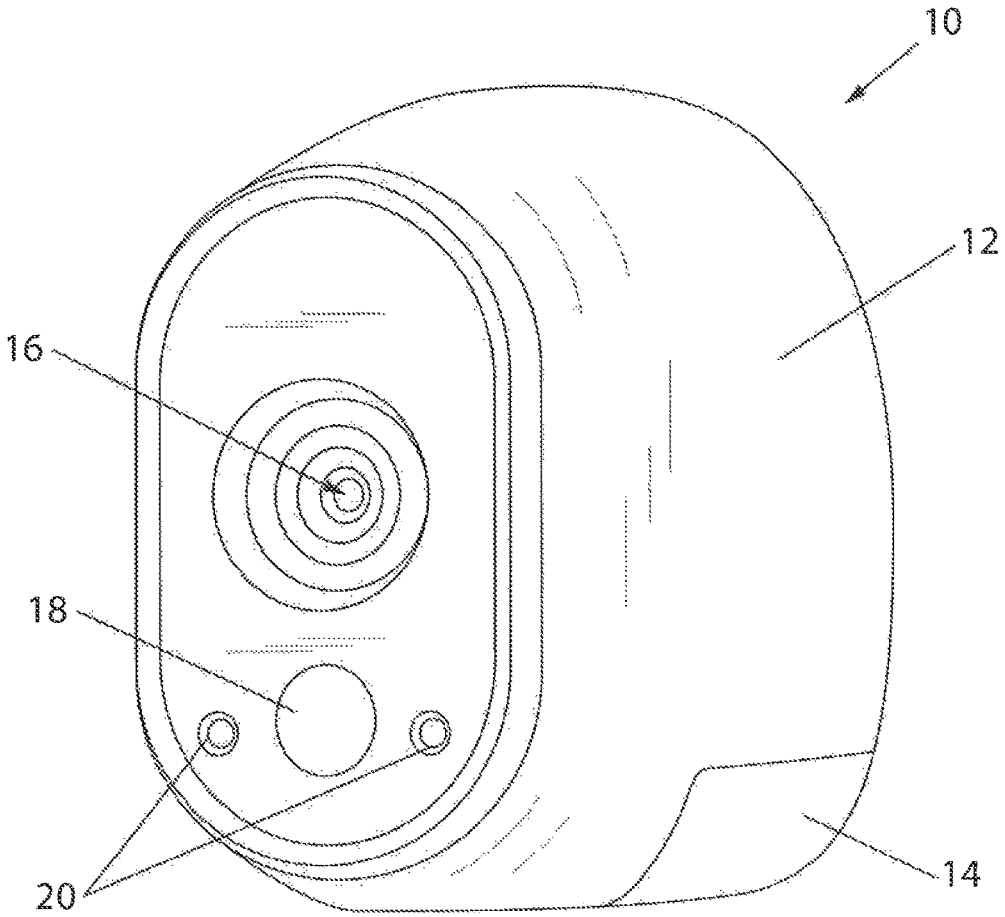
FIG. 1 is an isometric exemplar portable electronic device configured in accordance with an embodiment of the invention.

Referring now to FIG. 1, in accordance with an aspect of the invention, an exemplar portable electronic device 10 is provided, which device could be a wireless camera used in security system. The device 10 can be configured for wireless operation, including with respect to power and communications. The device 10 can include a housing 12 for packaging and protecting enclosed modules and circuitry. The housing 12 can include a panel 14 for accessing an interior of the device for maintenance, such as for battery replacement. When configured as a security camera, the device 10 can include a lens for focusing light to an image sensor 16, a motion sensor 18 for detecting movement in a field of view, and/or one or more Light Emitting Diodes (LED's) 20 for indicating states and/or supporting functions of the device. The motion sensor 18 could be an Infrared (IR) motion sensor operable to detect light radiating from objects. The LED's 20 could indicate states of the device, such as confirming synchronization with respect to a base station in the security system or confirming updates of firmware, and/or support functions of the device, such as projecting IR light for motion sensor 18 to detect.

Figure 2:
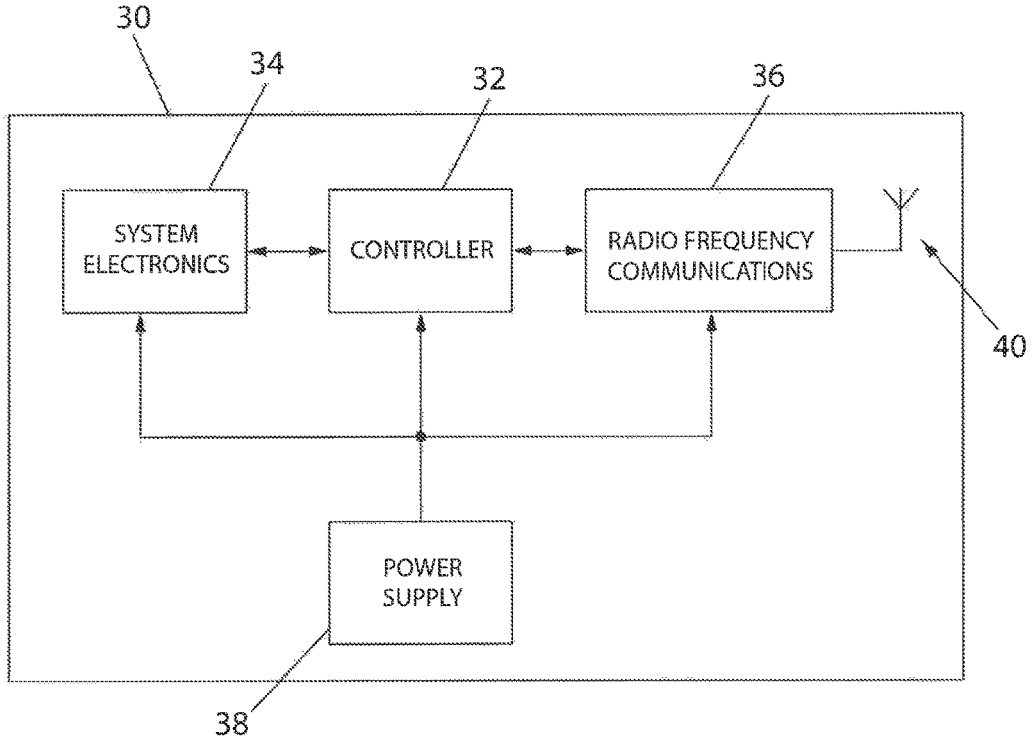
FIG. 2 is a block diagram of an electronic system for the device of FIG. 1.

Referring now to FIG. 2, an electronic system 30 for the device 10 can include a controller 32 in bidirectional communication with system electronics 34 and a Radio Frequency (RF) communications circuit 36. The device 10 including controller 32, the system electronics 34, and the RF communications circuit 36 can be powered by a wireless power supply 38, such as a rechargeable battery. Alternatively, the device 10 and its constituent components could be powered by an external power source.

The controller 32 can be a microprocessor, a microcontroller or system on a chip (SoC) configured to execute a program stored in a non-transient medium as known the art. The system electronics 34 can include circuitry for enabling the device 10 to accomplish a particular function. For example, when configured as a security camera, the system electronics 34 can include a high-resolution image sensor, a motion sensor, LED's, and the like, as well as discrete electrical components for implementing such function, such as resistors, capacitors, transistors, buffers, switches, and the like. The RF communications circuit 36 can be a radio frequency module configured to transmit and/or receive radio signals, according to a predetermined communications protocol, using one or more compact, embedded antennas 40. In one aspect, the RF communications circuit 36 can operate the one or more antennas 40 in the frequency range of 700 MHz to 3 GHz, and can communicate using a variety of communications protocols via the one or more antennas 40. Possible communications protocols include, but are in no way limited to, near field communications protocols, like Bluetooth; cellular communications protocols, like LTE, CDMA, and the like; as well as WLAN or Wi-Fi communications protocols, like IEEE 802.11. Accordingly, the controller 32 can interact with the system electronics 34 to accomplish a particular function of the device 10, such as detecting motion and receiving recorded video based on the motion via the motion sensor 18 and/or the image sensor 16, respectively, and communicate such interaction to other devices, such as transmitting the detected motion and/or the recorded video to a base station via the RF communications circuit 36 and the one or more antennas 40.

Figure 3:
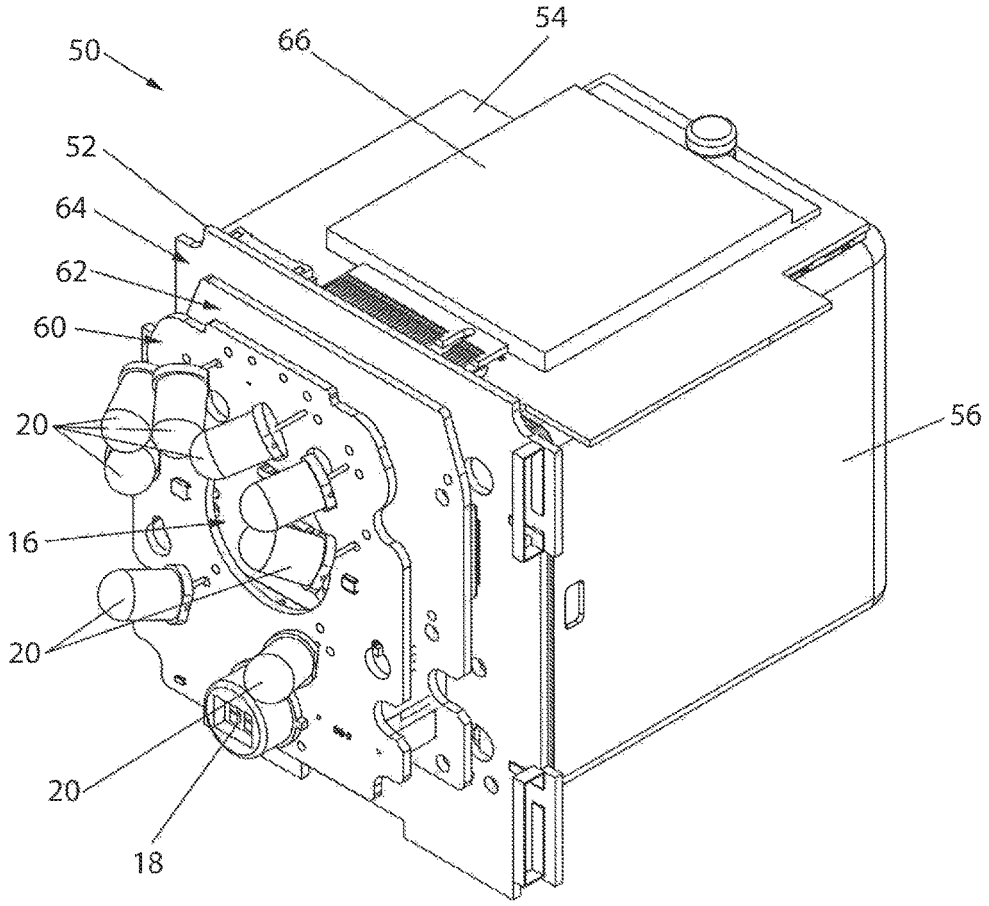
FIG. 3 is an isometric view of the device of FIG. 1, with the housing of the device removed.

Referring now to FIG. 3, an isometric view of the device 10, with the housing 12 removed for illustrating a communications system 50, is provided in accordance with a first embodiment of the invention. The communications system 50 includes a first conductive plane 52 electrically connected to a second conductive plane 54 to form the antenna 40. An edge of the second conductive plane 54 is electrically connected to the first conductive plane 52 by direct solder or fusing of their conductive materials.

As used herein, "conductive plane" refers to a substantially flat electrically conductive area which can serve as an electrical path for current flow. Each conductive plane can include or bear various geometric designs or patterns as desired for accomplishing the particular function of the device 10 within a predefined dimension or form factor established by the housing 12. The first conductive plane 52 provides an electrical ground, or current return path, for electrical components of the device 10, such as the system electronics 34 including the image sensor 16, the motion sensor 18 and/or the LED's 20. The second conductive plane 54, electrically connected to the first conductive plane 52, can operate as a ground plane extension of the first conductive plane 52. The first and second conductive planes 52 and 54, respectively, can extend at an angle to one another so that the conductive planes can be efficiently contained within the predefined dimension or form factor of the device 10. As used herein, an "angle" refers to the space within two planes diverging from a common line. The first and second conductive planes 52 and 54, respectively, may be disposed over different sides of an interior enclosure 56 which can hold the power supply 38, among other things. The first and second conductive planes 52 and 54, respectively, can extend orthogonal to one another in three dimensions, so as to form two sides of a cube to minimize space requirements. However, in other embodiments, first and second conductive planes 52 and 54, respectively, can extend at other angles depending on the shape, size and/or form factor of the device 10.

Figure 4:
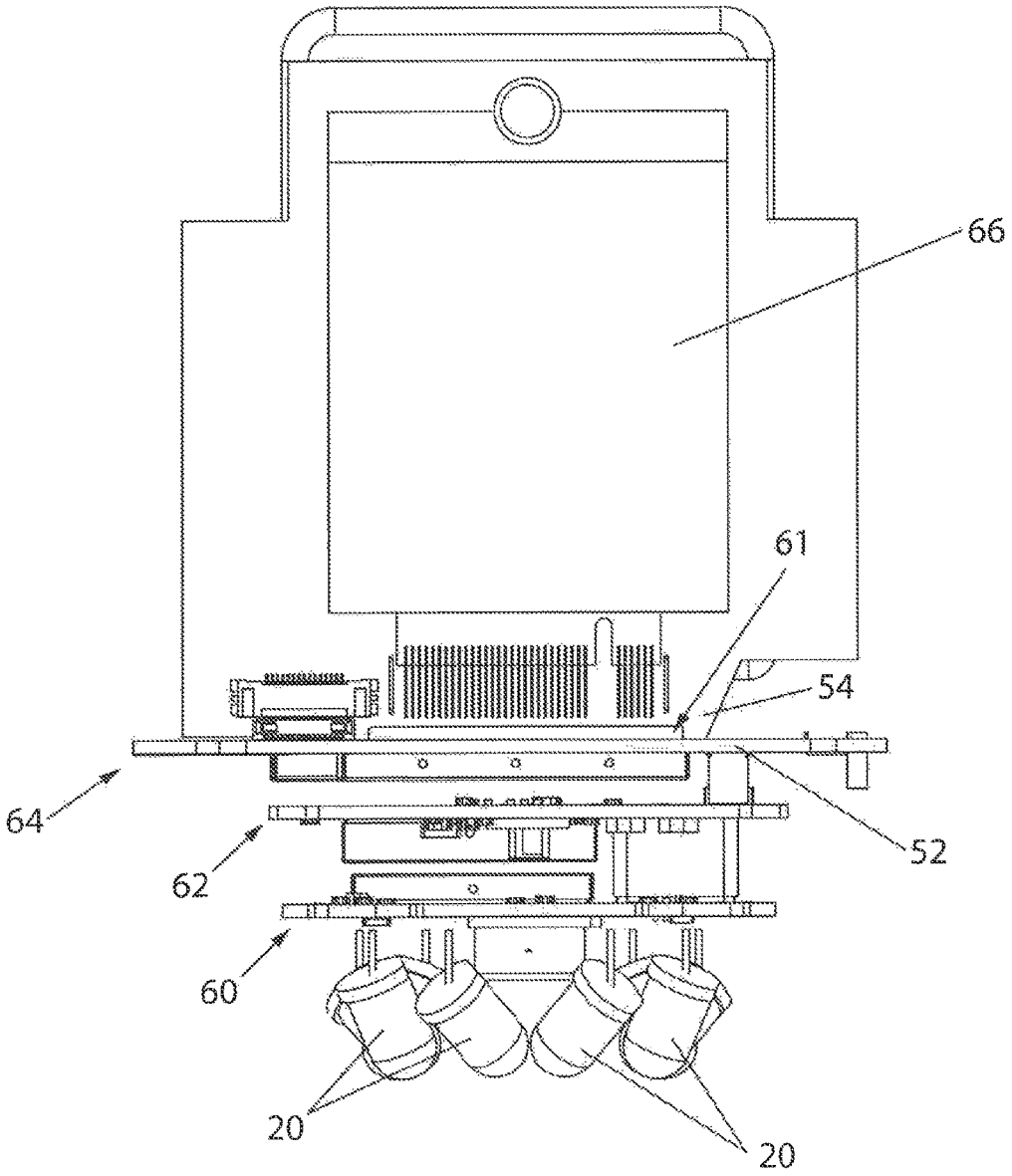
FIG. 4 is a top view of the device of FIG. 1, with the housing of the device removed.

In addition, with additional reference to FIG. 4 illustrating a top view of the device 10 with the housing 12 removed, the first and second conductive planes 52 and 54, respectively, can be configured to form a slot 61 between the conductive planes. The slot 61 could be a circumferentially enclosed oblong channel formed between intersections of the first and second conductive planes 52 and 54, respectively. This formation of the slot 61, between the first and second conductive planes 52 and 54, respectively, can allow the antenna 40 to effectively radiate, operating as a three-dimensional slot (or notch) antenna when driven by the RF communications circuit 36. A "slot antenna" is an antenna which consists of a conductive surface with one or more holes or slots cut out. When the conductive surface of a slot antenna is driven at a driving frequency, the slot can radiate electromagnetic waves in a way similar to a dipole antenna. Unlike a conventional slot antenna which may be formed by holes or slots cut out of a conductive surface that is a single conductive plane, the antenna 40 implements a slot antenna that is formed by a conductive surface which includes multiple conductive planes extending at angles to one another with the slot 61 in between the conductive planes, The shape and size of the slot 61, as well as the driving frequency driven by the RF communications circuit 36, can determine the radiation pattern. With the first and second conductive planes 52 and 54, respectively, operating as an antenna, the RF communications circuit 36 could be readily configured to enable at least near field communications such as Bluetooth.

The first conductive plane 52 could be a ground layer of a Printed Circuit Board (PCB). Moreover, one or both of the conductive planes, such as the first conductive plane 52 in the illustrated embodiment, could be on one PCB of multiple PCB's in a stack-up including a first PCB 60 for mounting the system electronics 34 thereon, a second PCB 62 (below the first PCB 60) for routing electrical connections and/or supporting additional electrical components, and a third PCB 64 (below the second PCB 62) providing the first conductive plane 52 in a ground layer. The system electronics 34 can connect to the ground layer of the first conductive plane 52 by through-hole conductive paths, vias and/or connectors, among other ways. The second conductive plane 54 could be, for example, a surface of a metal plate, or alternatively, a surface or boundary layer of another PCB.

The controller 32 and/or the RF communications circuit 36 could be arranged on a PCB in a detachable communications and control module 66. While the illustrated system electronics 34 are disposed over the first conductive plane 52, the communications and control module 66 alternatively could be disposed over the second conductive plane 54. Accordingly, the RF communications circuit 36 can provide a matching network antenna feed point by a through-hole conductive path and/or via to the second conductive plane 54 for transmitting RF signals. The RF communications circuit 36 providing the antenna feed point may be proximal to the slot 61. The RF communications circuit 36 can similarly receive RF signals picked up by the antenna via the second conductive plane 54, thereby operating as an RF transceiver.

Figure 5:
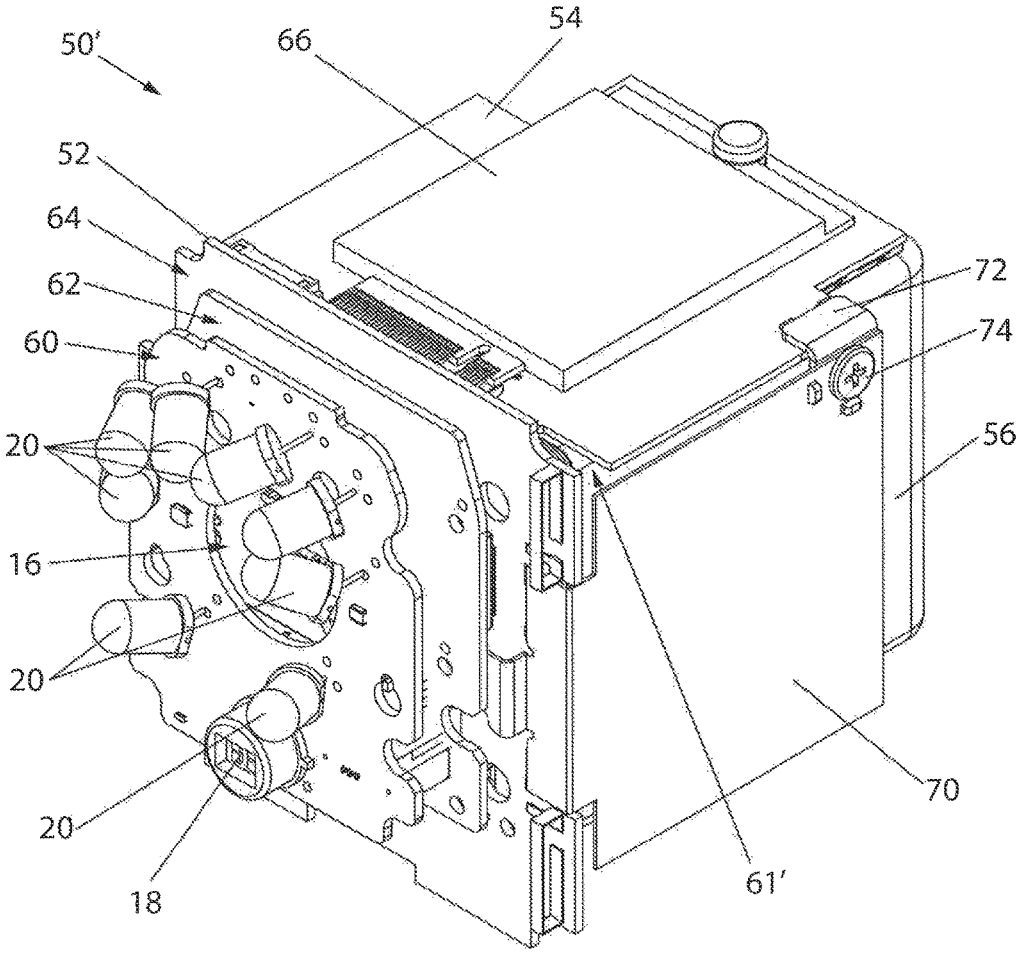
FIG. 5 is an isometric view of an alternative communications system constructed in accordance with a second embodiment of the invention.

Referring now to FIG. 5, an isometric view of the device 10, with the housing 12 removed for illustrating another communications system 50', is provided in accordance with a second embodiment of the invention, where like reference numerals denote like components throughout. The communications system 50' can include a first conductive plane 52 electrically connected to a second conductive plane 54 by direct solder or fusing of their conductive materials as discussed above with reference to FIG. 3. In addition, a third conductive plane 70 can be electrically connected to the first and second conductive planes 52 and 54, respectively, to form a slot antenna 40'. The distal edge of the second conductive plane 54 of this embodiment is electrically connected to a distal edge of the third conductive plane 70 by a conductive strip or bridge 72. The bridge 72 could be received by apertures in the second conductive plane 54, followed by an electrically conductive fastener to the third conductive plane 70, such as a screw 74. Accordingly, while the first conductive plane 52 provides an electrical ground, or current return path, for electrical components of the device 10, the second and third conductive planes 54 and 70, respectively, electrically connected to the first conductive plane 52, can operate as ground plane extensions of the first conductive plane 52. Moreover, the first, second and third conductive planes 52, 54 and 70, respectively, can extend at angles to one another so that the conductive planes can be efficiently contained within the predefined dimension or form factor of the device 10. The first, second and third conductive planes 52, 54 and 70, respectively, of the illustrated embodiment are disposed over different sides of the interior enclosure 56. Specifically, they are orthogonal to one another in three dimensions, so as to form three sides of a cube to minimize space requirements.

Figure 6:
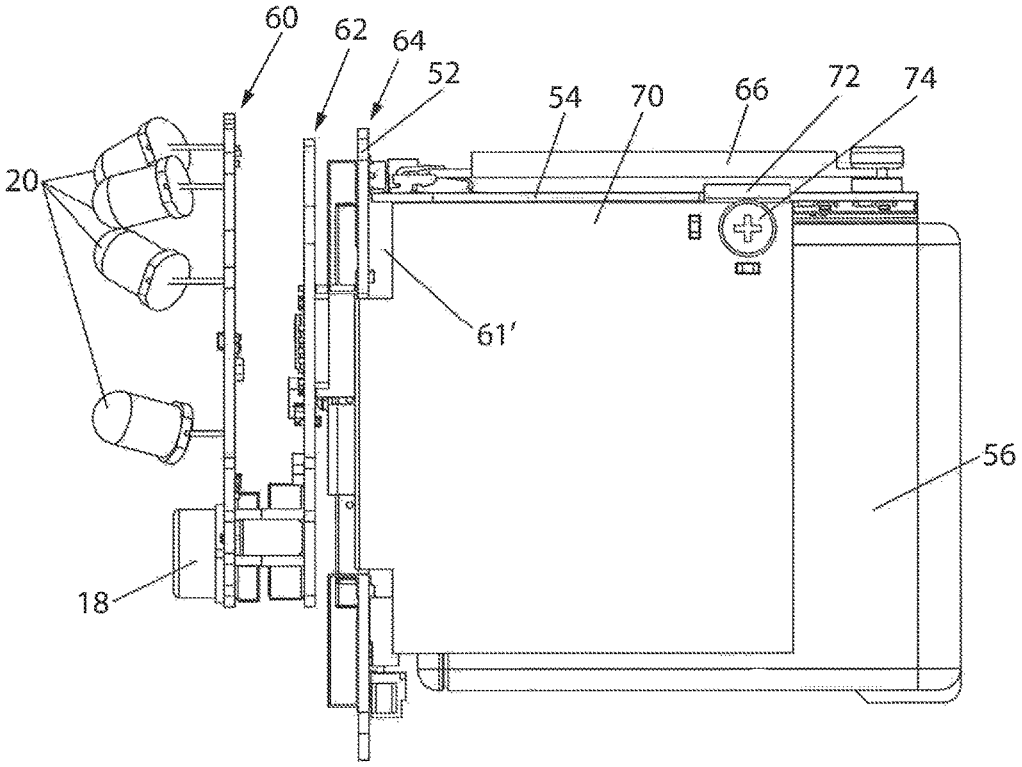
FIG. 6 is a side view of the alternative communications system of FIG. 5.

In addition, with additional reference to FIG. 6 illustrating a side view of the device 10 with the housing 12 removed, the first, second and third conductive planes 52, 54 and 70, respectively, are configured to form a slot 61' between the conductive planes and the bridge 72. The slot 61' of this embodiment is a circumferentially enclosed channel formed between interior edges of the first, second and third conductive planes 52, 54 and 70, respectively, and the bridge 72. The slot 61' can allow the antenna 40', formed by the first, second and third conductive planes 52, 54 and 70, respectively, and the bridge 72, to effectively radiate so as to operate as a larger three-dimensional slot (or notch) antenna when driven by the RF communications circuit 36. The shape and size of the slot 61', as well as the driving frequency driven by the RF communications circuit 36, can determine the radiation pattern. For example, the conductive planes can be arranged on sides facing directions in which it is desirable to achieve maximum communications distances. Moreover, the conductive planes can be made smaller to achieve shorter distance communications, such as Bluetooth, or larger to achieve longer distance communications, such as cellular. With the first, second and third conductive planes 52, 54 and 70, respectively, operating as an antenna, the RF communications circuit 36 could be readily configured to enable even greater RF communications, such as cellular communications like LTE, CDMA, and the like, as well as WLAN or Wi-Fi communications like IEEE 802.11.

The communications and control module 66 could again be disposed over the second conductive plane 54. However, in an alternative arrangement, the communications and control module 66 could be disposed over the third conductive plane 70. Accordingly, the RF communications circuit 36 can provide a matching network antenna feed point by a through-hole conductive path and/or via to the second or third conductive planes 54 or 70, respectively, for transmitting RF signals. The RF communications circuit 36 providing the antenna feed point may be proximal to the slot 61' at the bridge 72. The RF communications circuit 36 can similarly receive RF signals picked up by the antenna via the second or third conductive planes 54 or 70, respectively, thereby operating as an RF transceiver.

In alternative arrangements, additional conductive planes, slots and/or bridges could be configured on other sides of the device 10 in various ways to form multiple antennas. For example, using four opposing sides of the device 10, the two conductive planes of the communications system 50 of FIG. 3 could be combined with the three conductive planes of the communications system 50' of FIG. 5, each using a common conductive plane, such as the first conductive plane 52, and with slots in between, to form two slot antennas capable of communications at different frequencies. In addition, other antennas can also be added to the aforementioned communications systems to further enhance communication capabilities. For example, one or more micro strip antennas could be embedded in one or more of the aforementioned PCB's, one or more whip antennas attached the device 10, and the like. It will be appreciated that numerous variations exist within the scope of the invention.

Although the best mode contemplated by the inventors of carrying out the present invention is disclosed above, practice of the above invention is not limited thereto. It will be manifest that various additions, modifications and rearrangements of the features of the present invention may be made without deviating from the spirit and the scope of the underlying inventive concept.

It should be appreciated that such a development effort might be complex and time consuming, but would nevertheless be a routine undertaking of design, fabrication, and manufacture for those of ordinary skill having the benefit of this disclosure. Nothing in this application is considered critical or essential to the present invention unless explicitly indicated as being "critical" or "essential."

What is claimed is:

1. A communications system comprising:

a plurality of electrical components;

a first conductive plane providing an electrical ground for the plurality of electrical components;

a second conductive plane electrically connected to the first conductive plane to form an antenna comprising the first and second conductive planes, wherein the first and second conductive planes extend at an angle to one another;

a Radio Frequency (RF) communications circuit configured to communicate using the antenna; and a power supply, wherein the plurality of electrical components and the RF communications circuit are powered by the power supply, and wherein the first and second conductive planes are disposed over the power supply.

2. The system of claim 1, wherein the antenna includes a slot formed between the first and second conductive planes.

3. The system of claim 1, wherein the first and second conductive planes are orthogonal to one another.

4. The system of claim 1, wherein the first conductive plane is a layer of a Printed Circuit Board (PCB).

5. The system of claim 4, wherein the plurality of electrical components includes an image sensor and a Light Emitting Diode (LED).

6. The system of claim 1, further comprising a wireless power supply, wherein the plurality of electrical components and the RF communications circuit are powered by the wireless power supply.

7. The system of claim 1, wherein the power supply is provided in a power supply enclosure having a plurality of sides, and wherein the first and second conductive planes are disposed over different sides of the power supply enclosure.

8. The system of claim 7, further comprising a housing, wherein the plurality of electrical components, the first and second conductive planes and the RF communications circuit are enclosed in the housing.

9. The system of claim 1, wherein the RF communications circuit is configured for Bluetooth communication.

10. The system of claim 1, further comprising a third conductive plane electrically connected to the first and second conductive planes to form the antenna, wherein the first, second and third conductive planes extend at angles to one another.

11. The system of claim 10, wherein the antenna includes a slot formed between the first, second and third conductive planes.

12. The system of claim 10, wherein the first, second and third conductive planes are orthogonal to one another.

13. The system of claim 10, wherein the RF communications circuit is configured for Wi-Fi or cellular communication.

14. A wireless camera comprising:

a wireless power supply;

an image sensor powered by the power supply;

a first conductive plane providing an electrical ground for the image sensor;

a second conductive plane electrically connected to the first conductive plane to form an antenna comprising the first and second conductive planes, wherein the first and second conductive planes are at an angle to one another; and a Radio Frequency (RF) communications circuit configured to communicate using the antenna, wherein the first and second conductive planes are disposed over the power supply.

15. The wireless camera of claim 14, wherein the antenna includes a slot formed between the first and second conductive planes.

16. The wireless camera of claim 14, wherein the power supply is provided in a power supply enclosure having a plurality of sides, and wherein the first and second conductive planes are disposed over different sides of the power supply enclosure.

17. The wireless camera of claim 14, further comprising a third conductive plane electrically connected to the first and second conductive planes to form the antenna, wherein the first, second and third conductive planes extend angles to one another.

18. The wireless camera of claim 17, wherein the antenna includes a slot formed between the first, second and third conductive planes.

19. The wireless camera of claim 17, wherein the first, second and third conductive planes are orthogonal to one another.

20. A method for manufacturing a communications system comprising:

mounting a plurality of electrical components to a PCB;

providing a first conductive plane as an electrical ground for the plurality of electrical components;

electrically connecting a second conductive plane to the first conductive plane to form an antenna comprising the first and second conductive planes, wherein the first and second conductive planes extend at an angle to one another;

configuring an RF communications circuit to communicate using the antenna;

providing a power supply for powering the plurality of electrical components and the RF communications circuit; and disposing the first and second conductive planes over the power supply.

* * * * *